US010773142B2

(12) United States Patent
Orr

(10) Patent No.: US 10,773,142 B2
(45) Date of Patent: Sep. 15, 2020

(54) MULTI-SPORT TRAINING DEVICES, SYSTEMS, AND METHODS AND STANDS FOR MOUNTING MULTI-SPORT TRAINING DEVICES

(71) Applicant: Wendell Orr, White Plains, NY (US)

(72) Inventor: Wendell Orr, White Plains, NY (US)

( * ) Notice: Subject to any disclaimer, the term of this patent is extended or adjusted under 35 U.S.C. 154(b) by 85 days.

(21) Appl. No.: 16/020,296

(22) Filed: Jun. 27, 2018

(65) Prior Publication Data

US 2019/0134481 A1 May 9, 2019

Related U.S. Application Data

(60) Provisional application No. 62/526,333, filed on Jun. 28, 2017.

(51) Int. Cl.
*A63B 69/20* (2006.01)
*A63B 71/02* (2006.01)
(Continued)

(52) U.S. Cl.
CPC ..... *A63B 69/201* (2013.01); *A63B 69/24* (2013.01); *A63B 71/023* (2013.01);
(Continued)

(58) Field of Classification Search
CPC ... A63B 69/0092; A63B 69/201; A63B 69/24; A63B 69/38; A63B 2069/0008; A63B 71/023; A63B 2210/50; A63B 2244/10
See application file for complete search history.

(56) References Cited

U.S. PATENT DOCUMENTS 2,088,861 A * 8/1937 Blaine ..... A63B 69/345 473/442
2,334,360 A 11/1943 John
(Continued)

FOREIGN PATENT DOCUMENTS

| | | | |
|---|---|---|---|
| CN | 2882694 | Y | 3/2007 |
| GB | 2482540 | A | 2/2012 |
| KR | 20-0175820 | Y1 | 3/2000 |

OTHER PUBLICATIONS

"Fight Science Kick Test (Capoeira, Karate, Muaythai & Taekwondo)", Suellington Nunes, Nov. 9, 2010, https://www.youtube.com/watch?v=Gw4EoWi5QSM.
(Continued)

*Primary Examiner* — Megan Anderson
(74) *Attorney, Agent, or Firm* — Eric L. Lane; Green Patent Law

(57) ABSTRACT

A multi-sport athletic training device is provided, which is comprised of an elongate hollow container and a packing material. The elongate hollow container has a first end and a second end and is made of a flexible material. The first and second ends are closed to maintain the packing material within the elongate hollow container. The elongate hollow container is at least partially filled with the packing material such that the elongate hollow container absorbs impact and provides resistance. In exemplary embodiments, the packing material is sand. Exemplary embodiments of an athletic training device may further comprise two steel plates closing the first or second end of the container. Methods of manufacturing an athletic training device are also provided. A stand assembly for mounting an athletic training device is also provided.

20 Claims, 11 Drawing Sheets

(51) Int. Cl.

| | |
|---|---|
| ***A63B 69/24*** | (2006.01) |
| *A63B 69/38* | (2006.01) |
| *A63B 69/00* | (2006.01) |

(52) U.S. Cl.

CPC ..... *A63B 69/0091* (2013.01); *A63B 69/38* (2013.01); *A63B 2069/0008* (2013.01); *A63B 2210/50* (2013.01); *A63B 2244/10* (2013.01)

(56) References Cited

U.S. PATENT DOCUMENTS

| | | | | |
|---|---|---|---|---|
| 4,491,315 | A | 1/1985 | Dye | |
| 4,635,929 | A | 1/1987 | Shustack | |
| 5,111,771 | A | 5/1992 | Mathews | |
| 5,863,278 | A | 1/1999 | Chen | |
| 6,090,018 | A | 7/2000 | Laudenslager et al. | |
| 6,261,210 | B1 | 7/2001 | Lishejkov et al. | |
| 6,827,674 | B1 | 12/2004 | Ferry | |
| 6,893,384 | B2 | 5/2005 | Triani | |
| 6,974,389 | B1 | 12/2005 | Shioda | |
| 7,458,919 | B2 | 12/2008 | Giusti | |
| 7,488,276 | B2 | 2/2009 | Luigi | |
| 7,828,703 | B1 | 11/2010 | Boesch | |
| 7,867,148 | B2 | 1/2011 | Tsakiris | |
| 7,887,467 | B2 | 2/2011 | Booker | |
| 7,927,260 | B1 | 4/2011 | Stalka | |
| 8,029,422 | B2 | 10/2011 | Strong et al. | |
| 8,343,019 | B2 | 1/2013 | Friend | |
| 8,678,982 | B2 | 3/2014 | Pellot | |
| 8,900,103 | B1 | 12/2014 | Tabino | |
| 9,211,465 | B1 | 12/2015 | Lambrinos | |
| 9,358,441 | B2 | 7/2016 | Rea et al. | |
| 9,511,262 | B1 | 12/2016 | DePompe | |
| 9,586,120 | B1 | 3/2017 | Sotelo | |
| 9,616,286 | B1 | 4/2017 | Zamarripa | |
| 9,707,463 | B2 * | 7/2017 | Hudson | A63B 69/201 |
| 9,889,362 | B2 * | 2/2018 | Hoggatt | A63B 69/201 |
| 2015/0352423 | A1 * | 12/2015 | Almeras | A63B 69/201 482/89 |
| 2017/0021221 | A1 | 1/2017 | Hannula | |

OTHER PUBLICATIONS

International Search Report and Written Opinion dated Jan. 11, 2019 in related International Application No. PCT/US18/39751.

* cited by examiner

MULTI-SPORT TRAINING DEVICES, SYSTEMS, AND METHODS AND STANDS FOR MOUNTING MULTI-SPORT TRAINING DEVICES

CROSS-REFERENCE TO RELATED APPLICATION

This application claims priority to and benefit of U.S. Patent Application No. 62/526,333, filed Jun. 28, 2017, which is hereby incorporated by reference in its entirety.

FIELD OF THE DISCLOSURE

The present disclosure relates to a multi-sport, martial arts, law enforcement, and armed forces training device.

BACKGROUND

The sports and fitness industries include various sports such as baseball, golf, hockey, to mention a few, which require specialized training. However, many existing training methods are not portable, durable, or reasonably priced. In most of these sports, the intention is to deliver smooth coordinated and consistent power. Also, many existing training tools introduce variables and distractions such as balls, which may be extraneous when a coach or instructor is attempting to properly assess an athlete's body position, point of contact, and follow-through. Furthermore, some sports require other individuals to effectively learn and practice skills.

In the study of martial arts, one of the foundational principals is self-awareness and preparedness. Until this point is reached, within the individual and system application, many hours days and years of dedication are required. Knowing where your strengths and weaknesses are can provide greater consistencies to performance. However, a training partner is not always available to a martial arts practitioner, in general, or at a convenient time or location. Acquiring the skills could be very costly, not to mention time-consuming.

Thus, there is a need for multi-sport training devices, systems, and methods that are portable, durable, and provided at a reasonable price point. There is also a need for athletic training devices, systems, and methods that do not require a ball or puck or a partner to learn and practice skills.

SUMMARY

The present disclosure, in its many embodiments, alleviates to a great extent the disadvantages of known athletic training devices, systems, and methods. The present disclosure comprises a multi-sport training device that provides a free and uninhibited outlet for exercising and developing an individual's full range of skills. Disclosed athletic training devices, systems, and methods comprise an elongate hollow container or bag filled with a packing material such as sand and hung from a ceiling or a stand assembly such that the container absorbs the impact of, e.g., a baseball bat or tennis racket or a punch or kick and provides resistance as the user practices athletic movements. The device is a hard yet flexible tubular device that can be mounted or free standing.

This unique training tool can allow the coach or instructor to film and more properly assess the athlete's body position, point of contact and follow-through without the variables and distractions of a ball. Athletes see immediate results in their performance, and coaches gain a better understanding where the athlete must focus on to excel. Users can safely coordinate a training schedule for an individual or a group of people with the training device. All at a time and in a place that is convenient for the user's schedule. The training device would allow an athlete to train and increase their consistency, accuracy, and timing in their gym or home. Disclosed devices can provide tremendous value across many sports and martial arts industries. The portability, durability and economic pricing make disclosed devices very attractive for the growing sports and fitness market.

Disclosed devices, which have a broad scope of training applications, will revolutionize the training in many areas of sport, martial arts and defensive industries and has many market applications, including but not limited to sports, training, individuals, coaching, and kids. The training device also can fulfill a demand for an effective law enforcement training tool. The instructors can specifically teach the proper defensive and offensive attack points. The training device can help train eye contact to point of impact. It is useable in all types of weapons training as well.

In exemplary embodiments, an athletic training device comprises an elongate hollow container and a packing material. The elongate hollow container has a first end and a second end and is made of a flexible material. The first and second ends are closed to maintain the packing material within the elongate hollow container. The elongate hollow container is at least partially filled with the packing material such that the elongate hollow container absorbs impact and provides resistance. In exemplary embodiments, the packing material is sand.

Exemplary embodiments of an athletic training device may further comprise a first clamp assembly closing the first end of the container and a second clamp assembly closing the second end of the container. The first and second clamp assemblies may comprise a clamp, a screw, and a nut. In exemplary embodiments, the athletic training device further comprises at least one handle threaded through one or both of the first and second clamp assemblies. In exemplary embodiments, the handle is made of rope and may comprise a plastic tube maintaining the rope in a handle shape. In exemplary embodiments, the athletic training device further comprises a first plate and a second plate closing the first or second end.

In exemplary embodiments, the elongate hollow container comprises an internal lining. The elongate hollow container may further comprise an inner jacket outside the internal lining and an outer jacket outside the inner jacket. The elongate hollow container, in some embodiments, can absorb over 400 lbs of direct impact. In exemplary embodiments, the athletic training device is mounted on a stand assembly.

Exemplary embodiments of a stand assembly for an athletic training device comprise a first pipe and a second pipe being substantially equal in length, a third pipe being longer than the first and second pipe, a fourth pipe threaded through the third pipe, and a fifth pipe being substantially shorter than the first, second, and third pipes, the fifth pipe being attached to the fourth pipe via an elbow adapter. In exemplary embodiments, a T-connector and two elbow adapters are provided, and the first and second pipes are connected via the T-connector and elbow adapters such that they are substantially in the same plane. The third pipe may be connected to the first and second pipes via the T-connector and elbow adapters such that the third pipe extends at an angle from the plane. In exemplary embodiments, one or more routing eyebolts are attached to one or more of the first, second, and third pipes.

In exemplary embodiments, the stand assembly has an athletic training device mounted thereto, wherein the athletic training device comprises an elongate hollow container and a packing material. The elongate hollow container has a first end and a second end and is made of a flexible material. The first and second ends are closed to maintain the packing material within the elongate hollow container. The elongate hollow container is at least partially filled with the packing material such that the elongate hollow container absorbs impact and provides resistance. In exemplary embodiments, the packing material is sand. In exemplary embodiments, the elongate hollow container further comprises at least one clamp assembly, and the athletic training device is mounted to the stand assembly by the clamp assembly.

Exemplary methods of manufacturing an athletic training device comprise providing an elongate hollow container having a first end and a second end and being made of a flexible material, closing the first end of the elongate hollow container, at least partially filling the elongate hollow container with a packing material, closing the second end of the elongate hollow container to maintain the packing material within the elongate hollow container, and attaching a handle to one or both of the first and second ends. In exemplary embodiments, the closing steps comprise closing the first end with a first clamp assembly and closing the second end with a second clamp assembly. The attaching step may comprise threading the handle through one or both of the first and second clamp assemblies. In exemplary embodiments, the packing material is sand.

Exemplary manufacturing methods may further comprise mounting the athletic training device to a stand assembly wherein the stand assembly comprises a first pipe and a second pipe being substantially equal in length, a third pipe being longer than the first and second pipe, a fourth pipe threaded through the third pipe, and a fifth pipe being substantially shorter than the first, second, and third pipes, the fifth pipe being attached to the fourth pipe via an elbow adapter. In exemplary embodiments, a T-connector and two elbow adapters are provided, and the first and second pipes are connected via the T-connector and elbow adapters such that they are substantially in the same plane. The third pipe may be connected to the first and second pipes via the T-connector and elbow adapters such that the third pipe extends at an angle from the plane. In exemplary embodiments, one or more routing eyebolts are attached to one or more of the first, second, and third pipes.

Accordingly, it is seen that athletic multi-sport training devices, systems, and methods, along with stand assemblies for mounting training devices, are provided. These and other features and advantages will be appreciated from review of the following detailed description, along with the accompanying figures in which like reference numbers refer to like parts throughout.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION

In the following detailed description of exemplary embodiments of the disclosure, reference is made to the accompanying drawings in which like references indicate similar elements, and in which is shown by way of illustration specific embodiments in which disclosed systems and devices may be practiced. These embodiments are described in sufficient detail to enable those skilled in the art to practice the embodiments, and it is to be understood that other embodiments may be utilized and that logical, mechanical, functional, and other changes may be made without departing from the scope of the present disclosure. The following detailed description is, therefore, not to be taken in a limiting sense, and the scope of the present disclosure is defined by the appended claims. As used in the present disclosure, the term "or" shall be understood to be defined as a logical disjunction and shall not indicate an exclusive disjunction.

Figure 1A:
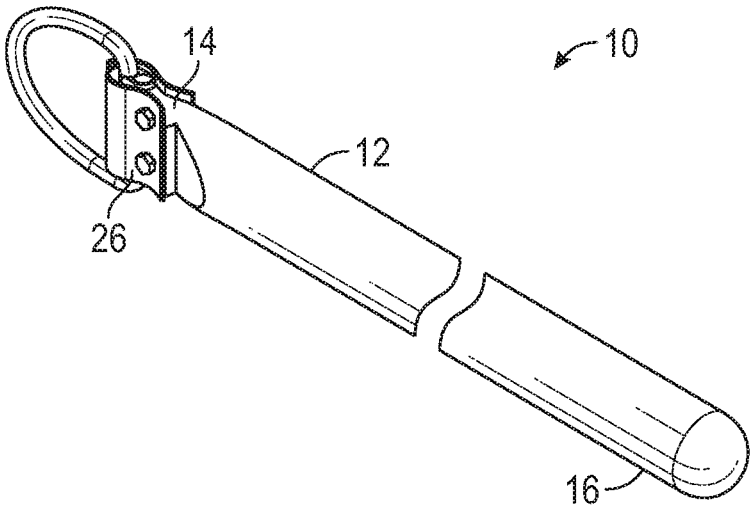
FIG. 1A is a perspective view of an exemplary embodiment of an athletic training device in accordance with the present disclosure.
Figure 1B:
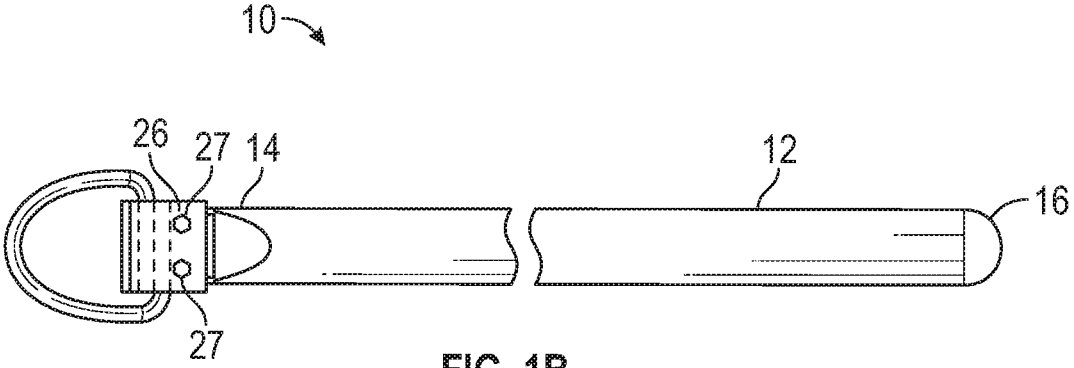
FIG. 1B is a front view of the athletic training device of FIG. 1A.
Figure 1C:
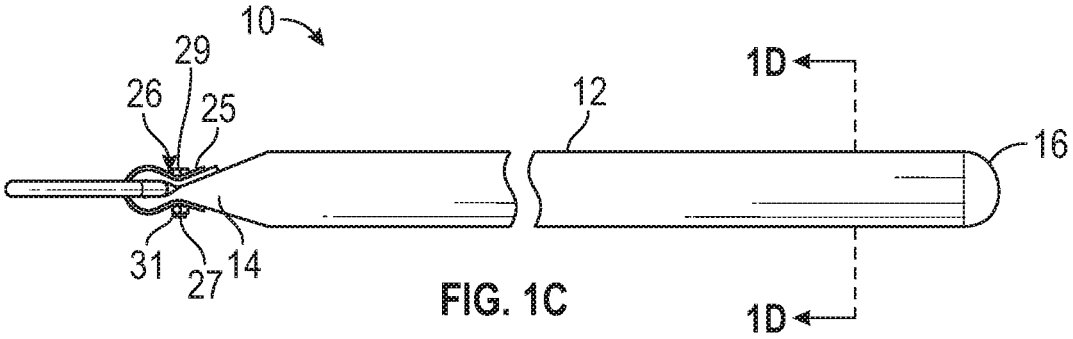
FIG. 1C is a side view of the athletic training device of FIG. 1A.
Figure 1D:
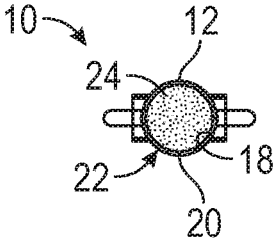
FIG. 1D is a cross-sectional view of the athletic training device of FIG. 1A.
Figure 2A:
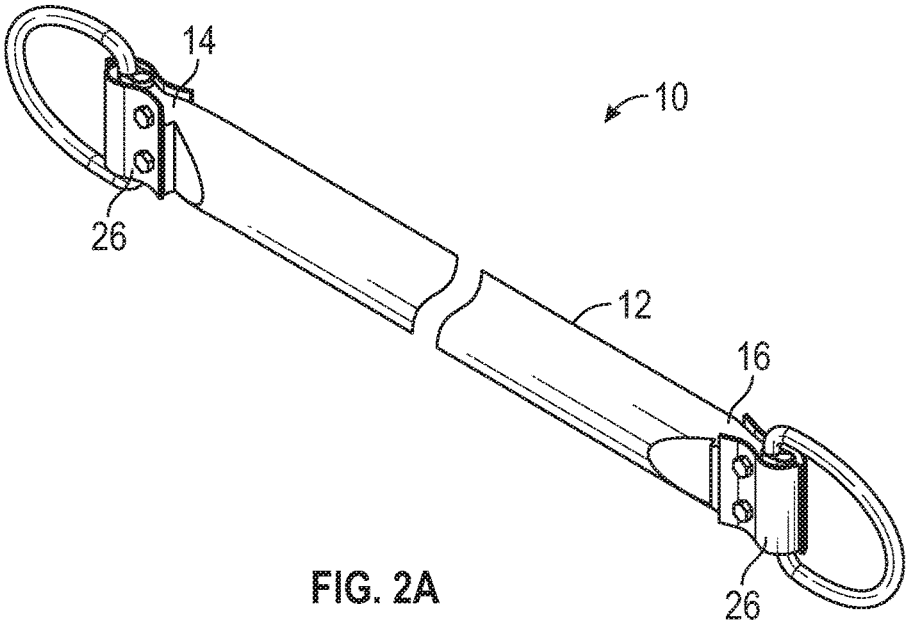
FIG. 2A is a perspective view of an exemplary embodiment of an athletic training device in accordance with the present disclosure.
Figure 2B:
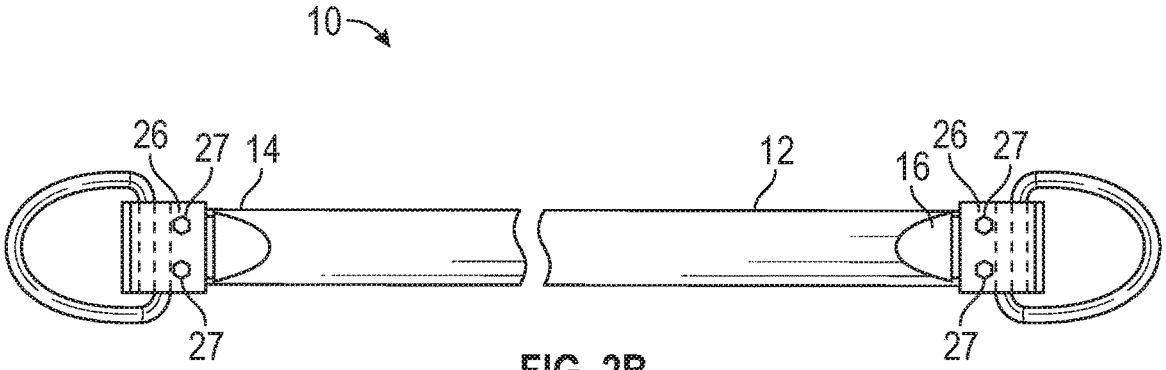
FIG. 2B is a front view of the athletic training device of FIG. 2A.
Figure 2C:
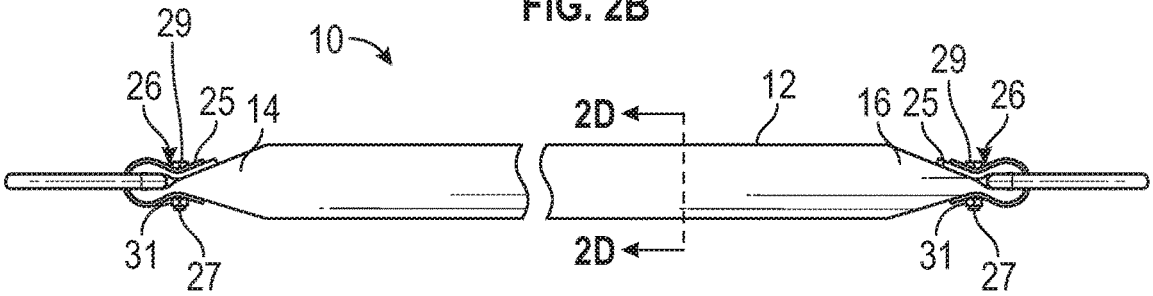
FIG. 2C is a side view of the athletic training device of FIG. 2A.
Figure 2D:
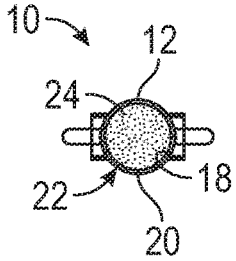
FIG. 2D is a cross-sectional view of the athletic training device of FIG. 2A.

FIGS. 1A-1D and 2A-2D illustrates an exemplary embodiment of a multi-sport athletic training device 10. The device 10 is comprised of an elongate hollow container or bag 12 having a first end 14 and a second end 16. The container or bag 12 can be made of any material that is both durable and flexible and, in exemplary embodiments, it is made of a length of fire hose. The length of hose could be open at both ends or have one open end and one closed end. In exemplary embodiments, the container 12 is substantially tubular and is double jacketed, as best seen in FIGS. 1D and 2D. More particularly, the elongate hollow container 12 comprises an internal lining 18, which may be an EPDM rubber lining. An inner jacket 20, which may be make of polyester is bound to the outside surface of the internal lining 18, and an outer jacket 22 located outside of the inner jacket 20. The outer jacket may be made of a woven polyester or other suitable material.

Exemplary athletic training devices are at least partially filled with a packing material 24. In exemplary embodiments, the packing material 24 is sand. As discussed in more detail herein, due to the tough material of the elongate hollow container 12 and the nature of the packing material 24, the training device 10 advantageously absorbs substantial impact and provides resistance for effective multi-sport training. In some embodiments, the training device 10 can absorb over 400 lbs of direct impact.

Depending on whether the elongate bag 12 is open on only end or on both ends, one or both of the first and second ends 14, 16 of the elongate bag 12 are tightly closed so the packing material 24 remains inside and does not leak out of the elongate bag 12. To effectively close the elongate container 12 any suitably strong fastening mechanisms could be used. In exemplary embodiments, a clamp assembly 26 is provided. Any strong clamp could be used, and an exemplary clamp assembly 26 includes a pipe repair clamp 25, one or more screws 27, one or more lock washers 29, and one or more nuts 31.

Figure 3A:
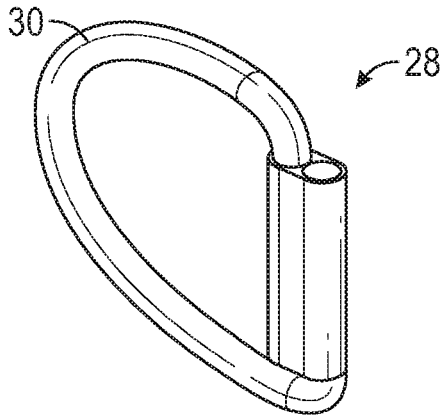
FIG. 3A is a perspective view of an exemplary embodiment of a handle for an athletic training device in accordance with the present disclosure.
Figure 3B:
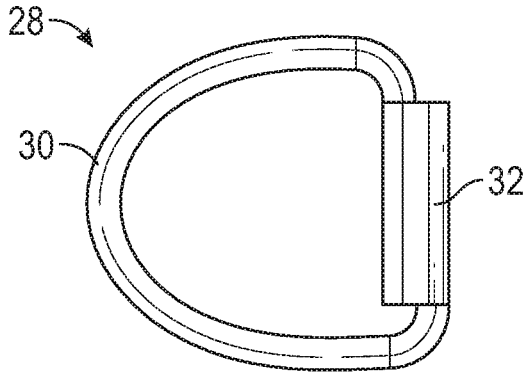
FIG. 3B is a front view of an exemplary embodiment of a handle for an athletic training device in accordance with the present disclosure.
Figure 3C:
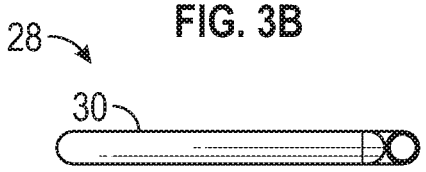
FIG. 3C is a side view of an exemplary embodiment of a handle for an athletic training device in accordance with the present disclosure.
Figure 4A:
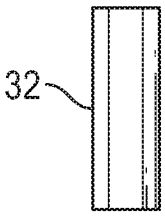
FIG. 4A is a front view of an exemplary embodiment of tube for a handle for an athletic training device in accordance with the present disclosure.
Figure 4B:
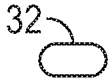
FIG. 4B is a side view of the tube of FIG. 4A.

With reference to FIGS. 3A-3C, in exemplary embodiments the athletic training device 10 has a handle 28. The handle 28 could be made of any suitable material and, in exemplary embodiments, is made of rope 30. More particularly, exemplary embodiments use pieces of static climbing rope. In exemplary embodiments, the rope material is one or more of high-strength skin polyester and high-strength nylon. As best seen in FIGS. 3B and 4A-4B, the ends of the rope may be disposed within a plastic tube 32 to maintain the rope in the shape of a handle. The handle 28 is attached to the elongate hollow tube 12 by being enclosed in one or both of clamp assemblies 26. The handle 28 could be attached to one or both ends 14, 16 of the elongate hollow container 12.

Figure 11:
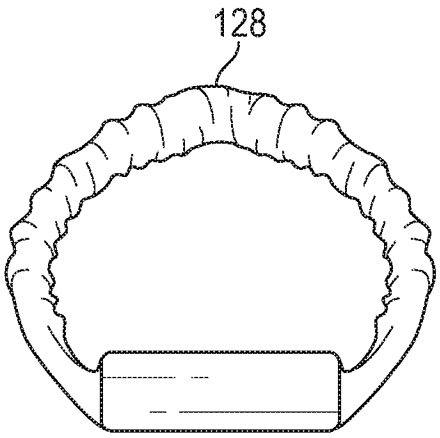
FIG. 11 is a front view of an exemplary embodiment of a handle for an athletic training device in accordance with the present disclosure.
Figure 10D:
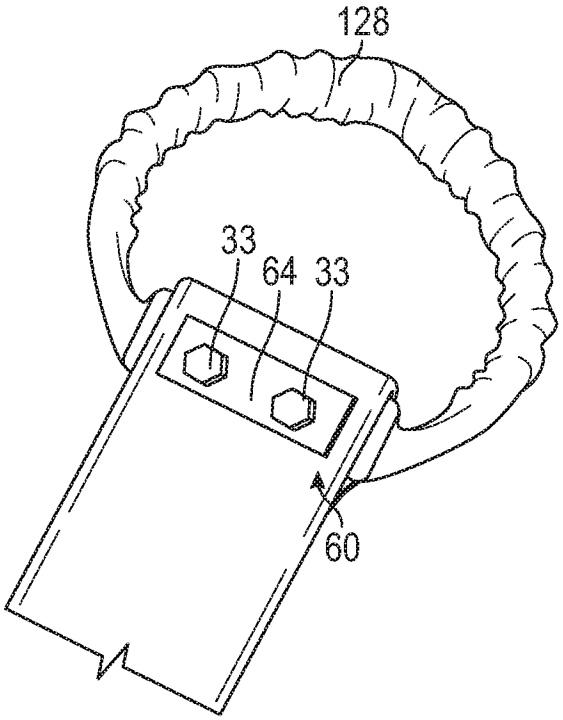
FIG. 10D is another perspective view of the plate assembly of FIG. 10C.
Figure 10C:
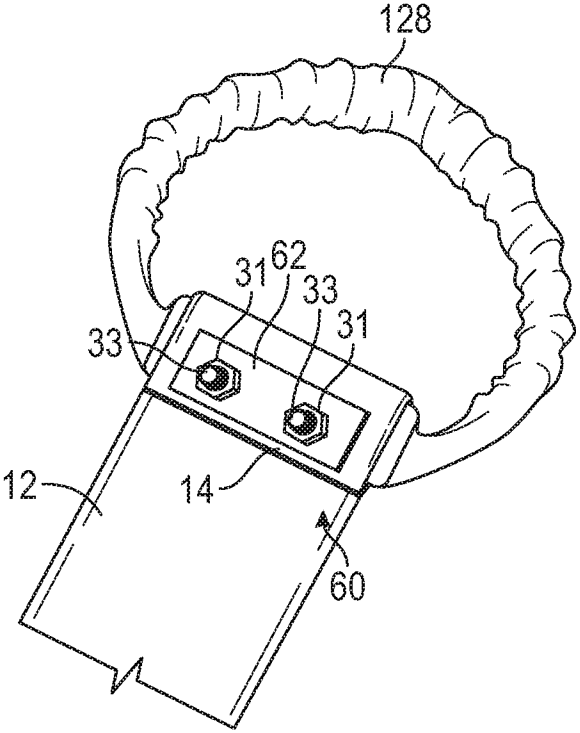
FIG. 10C is a perspective view of an exemplary embodiment of a plate assembly in accordance with the present disclosure.

In exemplary embodiments, instead of a clamp assembly, a plate assembly 60 could be used to close the ends 14, 16 of the elongate container 12. More particularly, as shown in FIGS. 10A-10D, an end 14 of the elongate container 12 is folded over and held closed by a first steel plate 62 on one side and a second steel plate 64 on the other side. The steel plates 62, 64 are fastened together with nuts 31 and bolts 33 to keep the end 14 of the elongate bag 12 closed. A piece of nylon webbing is stitched together and bunched up around a piece of shock cord to form a nylon laced elastic shock cord handle 128, best seen in FIG. 11. The nylon webbing is elastic with a rubber shock cord center so that the handle 128 advantageously absorbs impact. A cushion pad 66 and protective covering 68 enclose the sealed end 14 of the elongate container 12. Whether the elongate container 12 is closed with clamp assemblies 28 or plate assemblies 60, once the container is sealed the internal contents are water tight so the athletic training device 10 is weather proof.

Turning now to FIGS. 5A-5D, a stand assembly for mounting an athletic training device will now be described. The stand assembly 40 is made of several pipes about 1 inch in diameter of various lengths. More particularly, a first pipe 42 and a second pipe 44 are substantially equal in length, in exemplary embodiments about 3'×1" lengths. The first and second pipes 42, 44 are connected via a T-connector 51 and elbow adapters 53, best seen in FIGS. 6A-6C, such that they are substantially in the same plane and form the base 46 of the stand assembly 40. A third pipe 48 is a little bit longer than the first and second pipes 42, 44, typically about 4'×1" length and is connected to the first and second pipes via the T-connector and elbow adapters such that the third pipe extends at an angle from the plane of the base 46. The third pipe 48 is the primary component that allows the training device 10 to hang at an appropriate height for use.

Figures 5A, 5B, 5C:
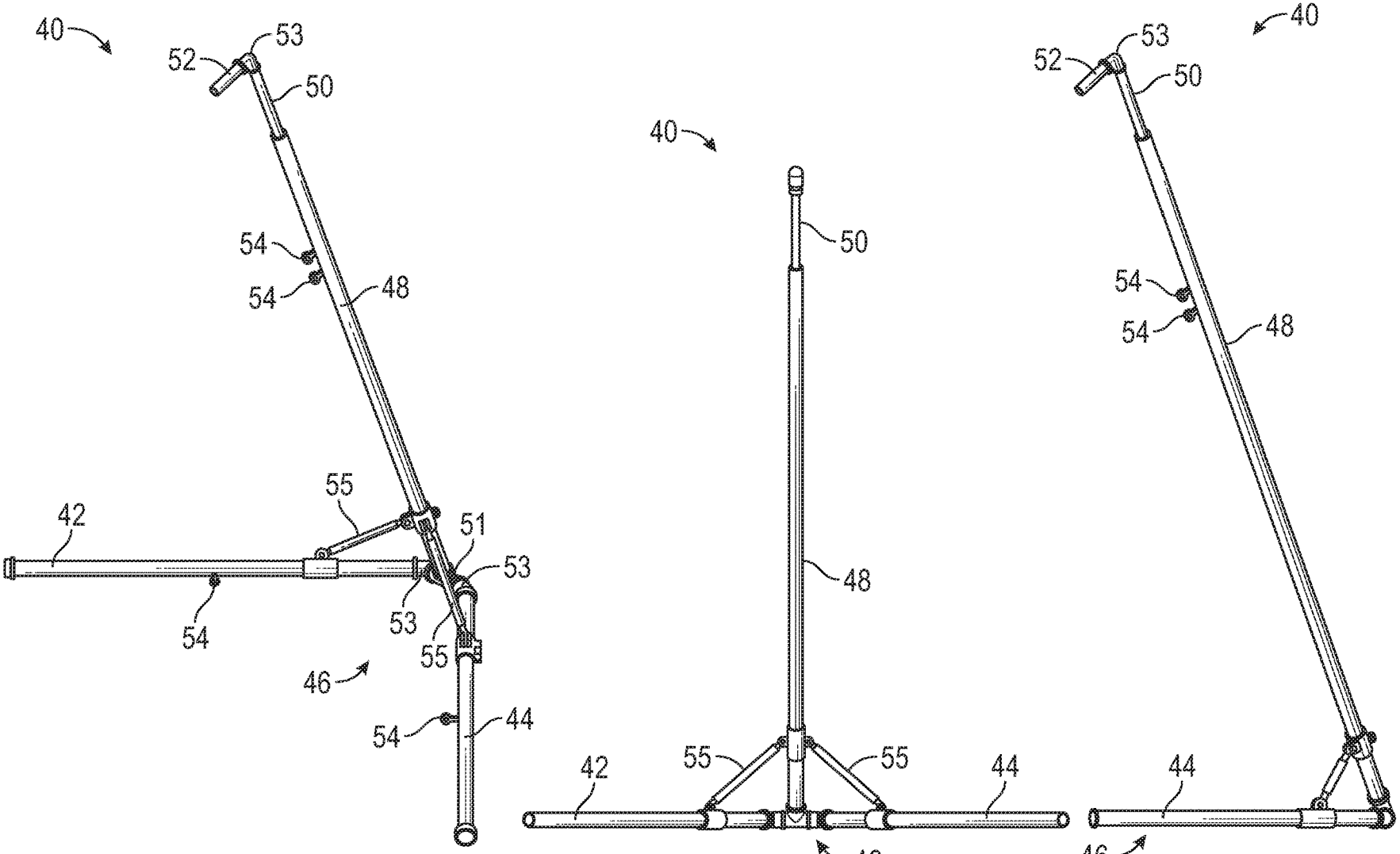
FIG. 5A is a perspective view of an exemplary embodiment of a stand assembly for an athletic training device in accordance with the present disclosure.
FIG. 5B is a front view of the stand assembly of FIG. 5A.
FIG. 5C is a side view of the stand assembly of FIG. 5A.
Figure 5D:
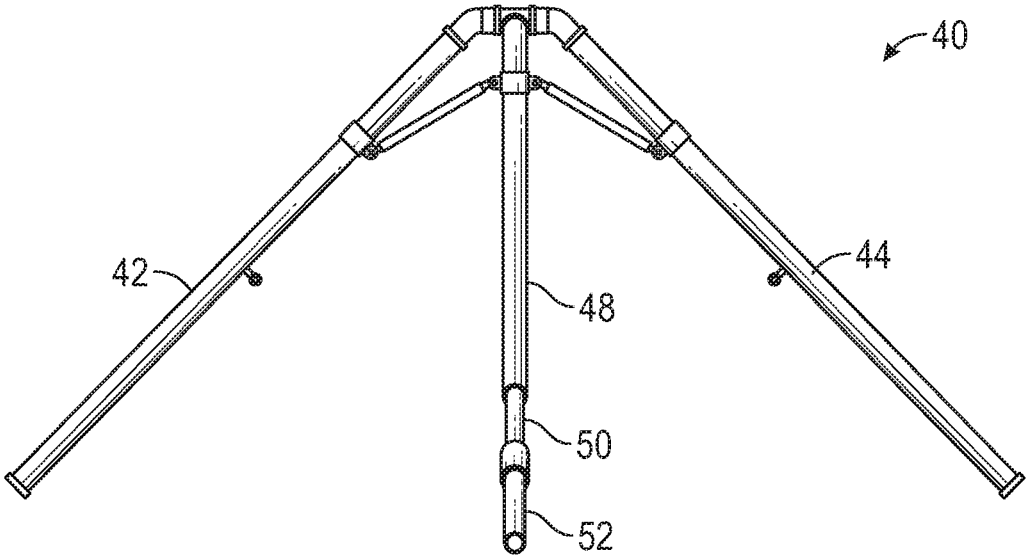
FIG. 5D is a cross-sectional view of the stand assembly of FIG. 5A.
Figure 6A:
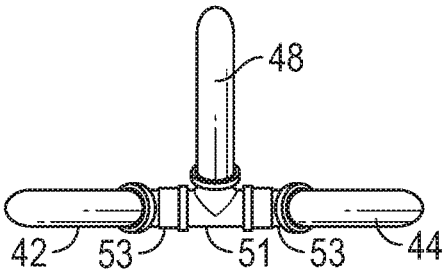
FIG. 6A is a front view of exemplary embodiments of a T-connector and elbow adapter for a stand assembly in accordance with the present invention.
Figure 6B:
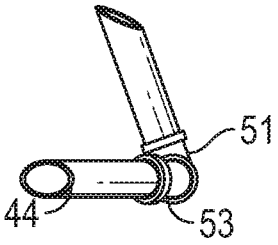
FIG. 6B is a side view of the T-connector and elbow adapter of FIG. 6A.
Figure 6C:
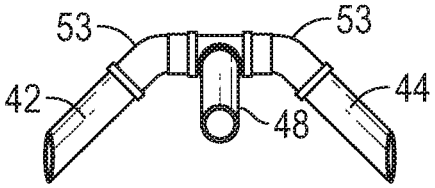
FIG. 6C is a top view of the T-connector and elbow adapter of FIG. 6A.
Figure 7:
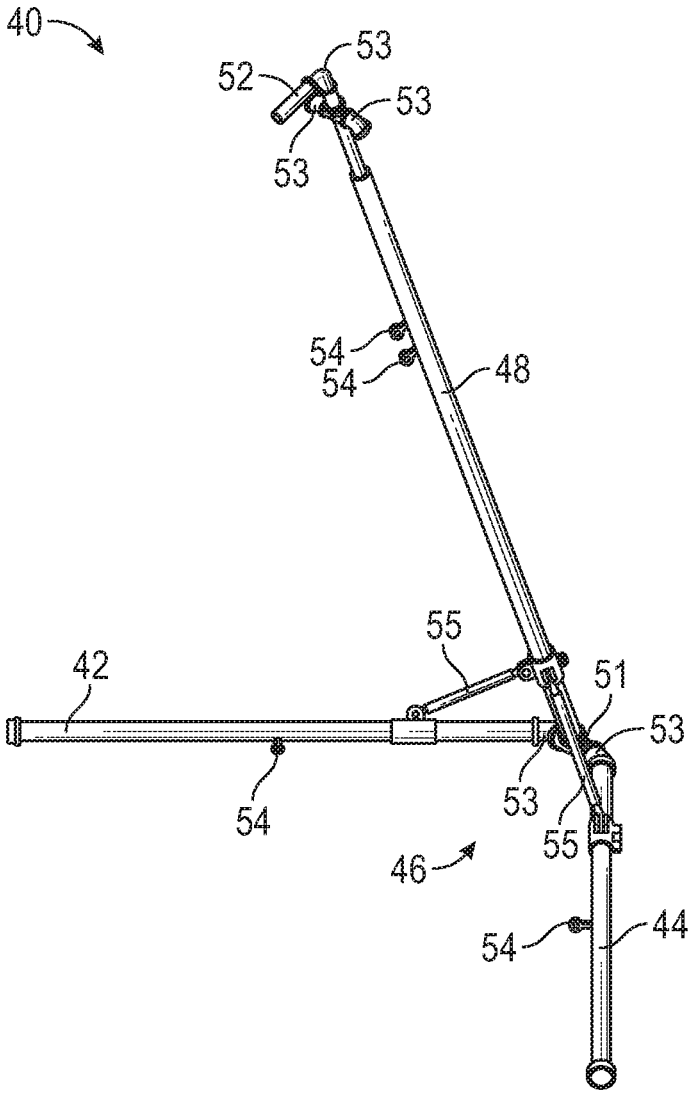
FIG. 7 is a perspective view of an exemplary embodiment of a stand assembly for an athletic training device in accordance with the present disclosure.
Figure 8B:
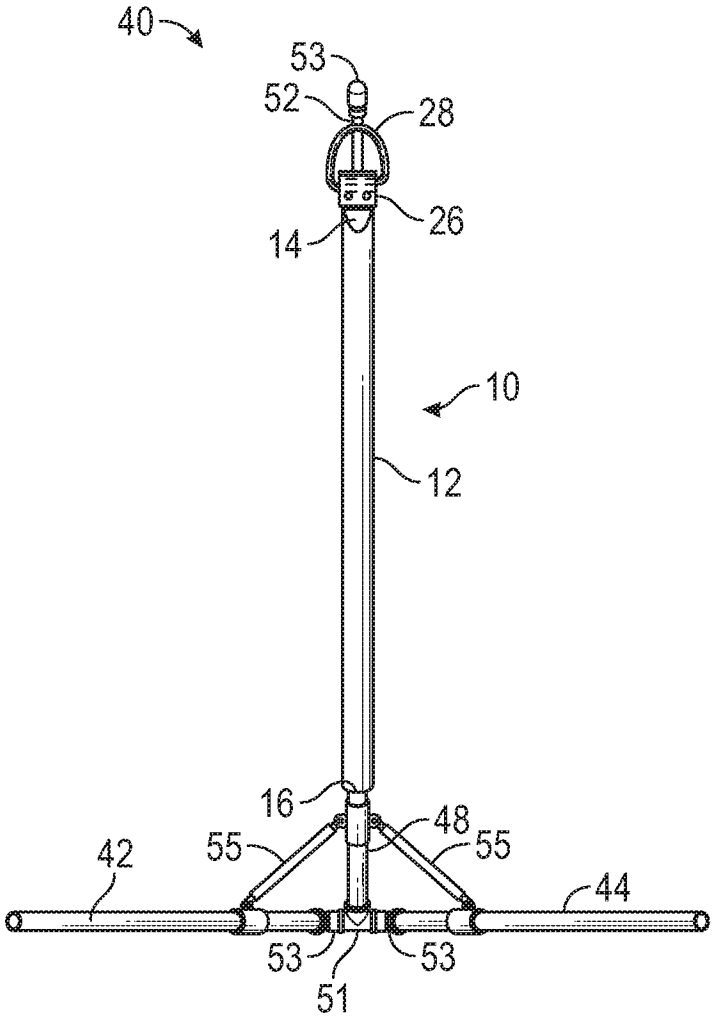
FIG. 8B is a front view of the stand assembly of FIG. 8A.
Figure 8A:
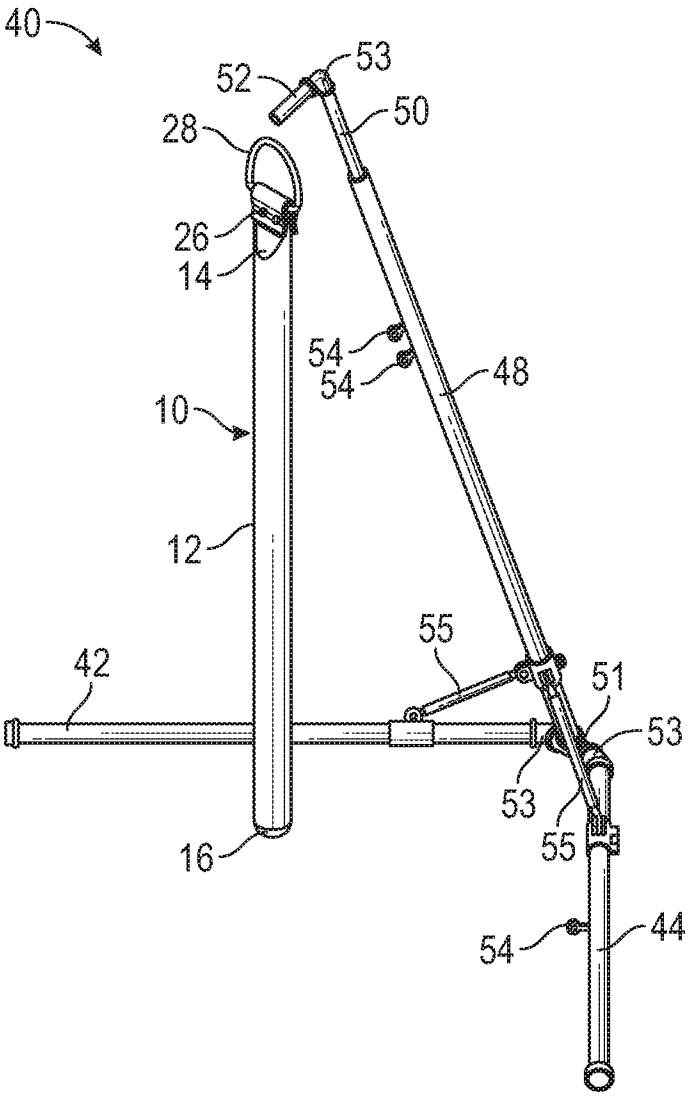
FIG. 8A is a perspective view of an exemplary embodiment of a stand assembly showing an athletic training device mounted thereto in accordance with the present disclosure.
Figure 8D:
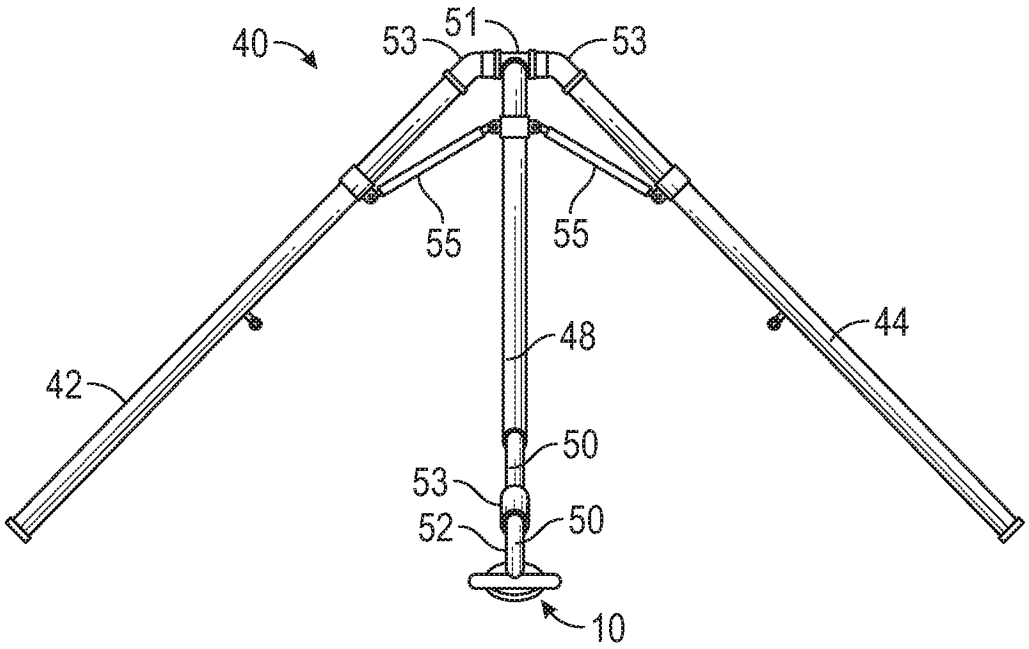
FIG. 8D is a cross-sectional view of the stand assembly of FIG. 8A.
Figure 8C:
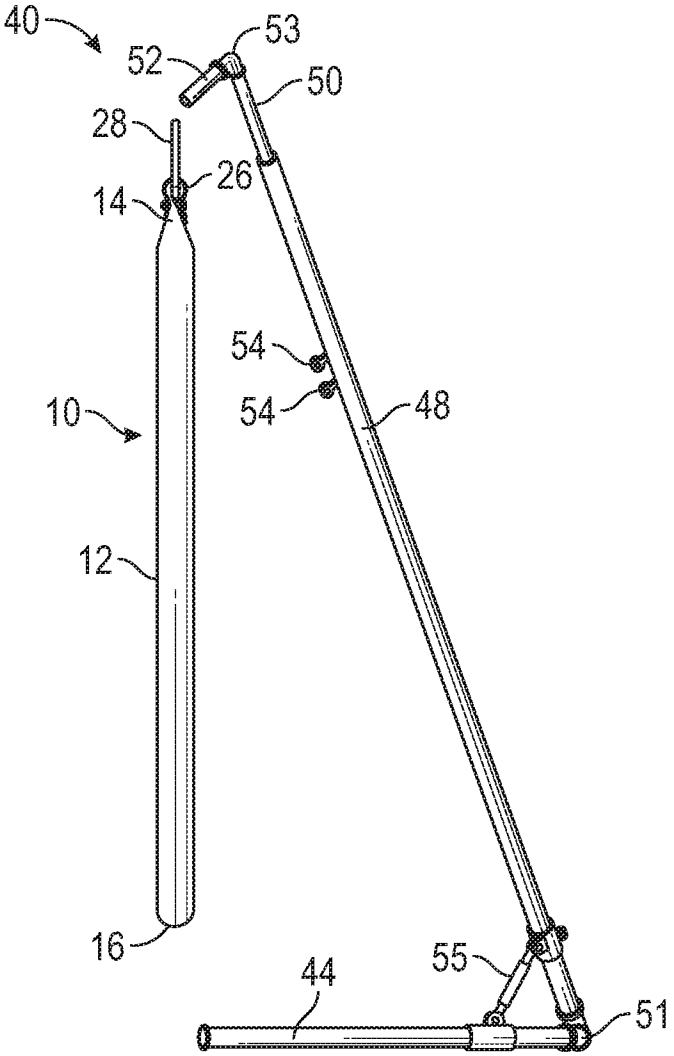
FIG. 8C is a side view of the stand assembly of FIG. 8A.

A fourth pipe 50 may be threaded through the third pipe 48, and a fifth pipe 52 may be attached to the fourth pipe via an elbow adapter 53. The fifth pipe 52 is substantially shorter than the other pipes and serves as the mounting point for the training device 10. In exemplary embodiments, one or more routing eyebolts 54 are attached to one or more of the first, second, and third pipes. As best seen in FIG. 5A, in exemplary embodiments two or more routing eyebolts 54 are located on the third pipe 48 and/or other pipes as needed and may serve to help secure the training device 10 to the stand assembly 40. Sub-assembly support members 55 may be used, for example as shown in FIGS. 5A and 5B attached between the first and third pipes 42, 48 and between the second and third pipes 44, 48, to provide additional support to the stand assembly 40. Any suitable pipe could be used, but for durability, ease of use, and aesthetics black plumbing pipe typically would be used. While the basic version of the stand assembly 40 mounts one training device 10, it should be noted that the stand assembly could be expanded using repeated arrangements of additional pipes to mount multiple training devices. As shown in FIG. 7, 45-degree elbow adapters 53 could be connected to fifth pipe 50, or other pipes as needed, to provide attachment points for additional pipes to mount additional training devices.

The athletic training device 10 is manufactured by obtaining a suitable hollow tube or container, which could be a section of fire hose about 4-6 feet long and about 2-3 inches in diameter. The tube or container 12 should have certain specifications for durability and resistance, examples of which are shown in the following chart:

| Size | Service Test | Proof Test | Burst Test | Weight Per Foot Uncoupled | Width Laying Flat | Bowl Size |
|---|---|---|---|---|---|---|
| 2" | 400 psi | 800 psi | 1200 psi | .33 lbs | 3" | 2⅖" |
| 2½" | 400 psi | 800 psi | 1200 psi | .47 lbs | 4⅜" | 3" |
| 3" | 400 psi | 800 psi | 1200 psi | .58 lbs | 5" | 3 17/32" |
| 4" | 300 psi | 600 psi | 900 psi | .77 lbs | 6⅝" | 4 17/32" |
| 5" | 300 psi | 600 psi | 900 psi | .92 lbs | 8 5/16" | 5½" |

It should be noted that these specifications are by way of example only. Different specifications would also work, and those skilled in the art would be able to vary the specifications depending on the application.

Additional materials used to make exemplary embodiments of an athletic training device include but are not limited to EPDM liner—internal rubber lining; polyester inner jacket—bound to the EPDM liner; polyester outer jacket—outer woven jacket; two pieces of static climbing rope, which could be made of high-strength skin polyester+ high-strength Nylon66, as just one example; two or more pipe clamps; two or more rubber gaskets; two or more plastic tubes; bolts and nuts.

An exemplary manufacturing method for an athletic training device could include the following steps. To make the handle 28, cut two pieces of climbing rope, melt the ends to a point, pass both ends through the piece of plastic, and flare out the ends with heat to eliminate it pulling through. To make the elongate container 12 into a suitable athletic training device, cut a section of fire hose, place the rope over the hose, leave an overlap of hose, and place one of the gaskets between the flapped training device body. Then, to close an end of the elongate container, in some embodiments, the manufacturer clamps the rope and hose assembly down, drill holes through the clamp, hose, and rubber gasket assembly, place the bolts in and tighten them down, and cut the excess threads off the bolt. The clamp could be foam wrapped and taped to hold it in place, the cover finished in leather. Then fill the elongate container 12 with a packing material 12 such as sand. The closing steps could be repeated on the other end to completely close the elongate container. Performance tests could be conducted if desired.

As discussed above, in exemplary embodiments, an end 14 of the elongate container 12 is folded over and held closed by a first steel plate 62 on one side and a second steel plate 64 on the other side. The steel plates 62, 64 are fastened together with nuts 31 and bolts 33 to keep the end 14 of the elongate bag 12 closed. A piece of nylon webbing is stitched together and bunched up around a piece of shock cord to form a nylon laced elastic shock cord handle 128. The sealed end 14 of the elongate container 12 is then enclosed with a cushion pad 66 and protective covering 68. In exemplary embodiments, the first end 14 will be fixed and the second end 16 will be open with bolts that can be torqued down to pre-set setting and then break off. This advantageously allows the athletic device to be shipped "dry" without a packing material, and the user would fill the elongate container with the packing material upon delivery. This advantageously enables functional shipping and efficient delivery.

An exemplary manufacturing method for a stand assembly 40 includes first obtaining various lengths of plumbing pipe. For a single training device stand, the manufacturer would obtain two lengths of pipe of about the same length, one pipe of a slightly longer length, two caps, two street elbows, one tee, one nipple, two-four eye bolts made of stainless steel or other suitable material, one piece of climbing rope, two bungees, and one carabiner. For a triple training device stand, the manufacturer would need to make the following modifications: additional caps, at least two additional street elbows, at least one additional climbing rope, four bungees, and three carabiners.

The manufacturer would perform the following steps to produce an exemplary stand assembly for an athletic training device. First, thread the street elbows into the T, maintaining about a 15-30 degree angle on the T and about a 90 degree angle on the street elbows. Then tighten in place the T and the street elbows in place. Drill a hole in the T at its flared end, press in steel spring pins, and grind to a flush finish. Next, there are a series of drill and tap steps, including drilling a hole about 1-2 feet off the tip of the first and second pipes, drilling a hole about a foot from the top of the third pipe, and tapping each hole. Then, thread in the pipes, i.e., thread in the first and second pipes, then place the caps on, thread in the third pipe, and thread the T to the first pipe. Then add the nipple, thread the rope through the T and pipe, secure it, paint the stand assembly, and conduct a performance test if needed.

Figure 9:
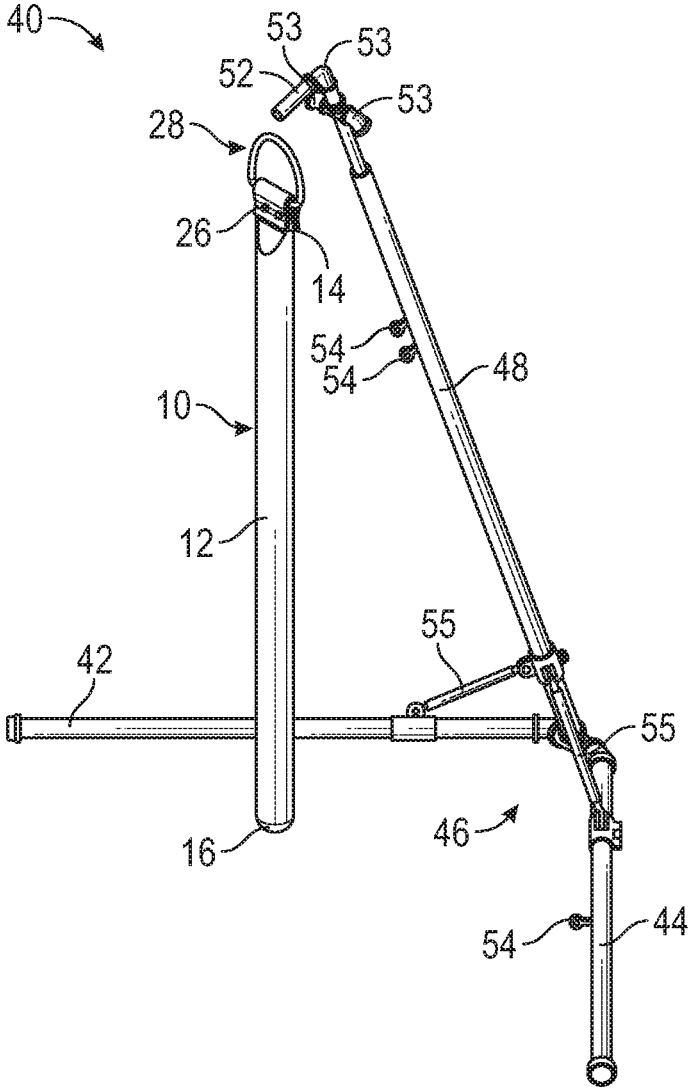
FIG. 9 is a perspective view of an exemplary embodiment of a stand assembly showing an athletic training device mounted thereto in accordance with the present disclosure.
Figure 10B:
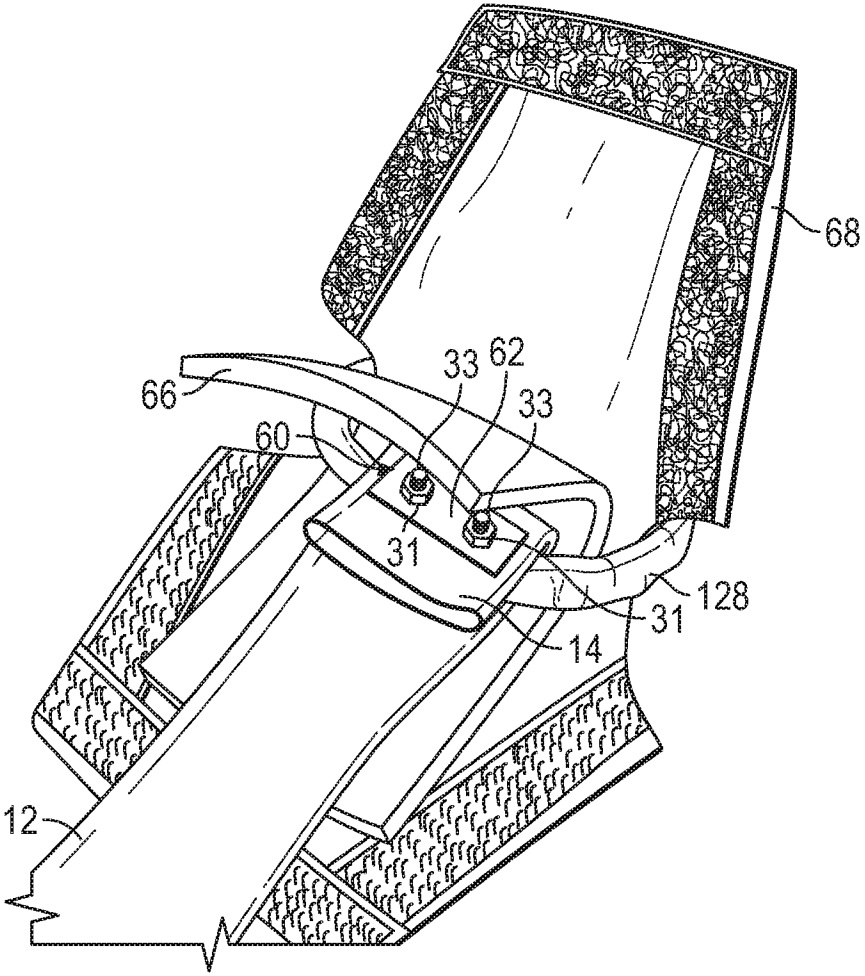
FIG. 10B is an exploded view of the end of FIG. 10A.
Figure 10A:
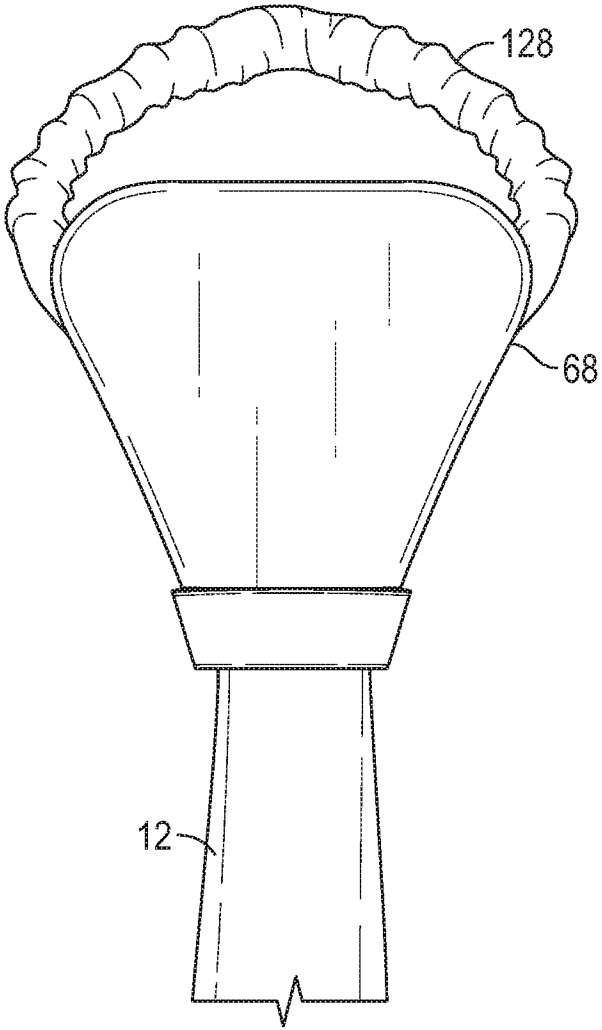
FIG. 10A is a front view of an exemplary embodiment of a closed end of an athletic training device in accordance with the present disclosure.

To mount the athletic training device 10 to the stand assembly 40, the user hangs the athletic training device to the top of the stand. More particularly, as illustrated in FIGS. 8A-8D and 8, the handle 28 at the top end 14 of the training device 10 could be fitted onto fifth pipe 52. Additional rope or other fasteners could be used to secure the athletic training device 10 to the stand assembly 40. The training device would be attached so, in a hanging position, the bottom end 16 is off the ground. Wires or strings could be threaded through one or more of the routing eyebolts 54 to maintain the training device 10 in position to reduce the amounting of swinging and increase resistance. As shown in FIG. 9, additional pipes could be added to mount additional training devices via 45-degree elbow adapters 53 connected to fifth pipe 50.

In operation, the user or trainee hangs the athletic training device 10 by its first end 14 so it is substantially vertical in orientation. The training device 10 could be hung from a hook or pipe on the ceiling of any room, from a stand assembly 40 as describe above, or from any suitable bar or pipe indoors or outdoors. The training device 10 could be attached from the first end 14 only so it is free-standing, or it could be attached from the first end 14 at the top and the second end 16 at the bottom so it is fixed in position. The installations could vary based on the intended use of the training device.

The trainee would then stand within a 6' radius of the training device to allow for full range of motion. The trainee practices the motions of the sport or martial art or defensive art and strikes the training device 10 at any point along the length of the elongate container 12, either with the hands, fists, baseball bat, hockey stick, golf club, tennis racket, martial arts or defense weapon, or any other part of the body or instrument. The training device 10 will absorb the impact of these strikes and provide resistance so the trainee has the experience of hitting a ball, puck, or another individual simply by engaging with the device. The training device 10 can withstand over 400 lbs of direct impact and, due to the durability of the materials it is made of, is substantially maintenance free. Once properly installed, no other repairs or adjustments are needed.

The training device can provide training in the following areas: coordinated movements through resistance; directional variation to angle of impact; hand-eye coordination for empty or items of extension; specific target areas of contact; develop and exercise power; postural positioning;

body mechanic and conditioning; self-defense training. The training device can replace the old ball and tee system of hitting practice. The only focus of the user would be where the bat will make contact and the position of his or her body. Other areas of training device training include: develop defensive tactics; learn defined "No-Go" impact areas; teach non-lethal defense techniques; accurate points of contact for less than lethal contact.

While the disclosed systems and devices have been described in terms of what are presently considered to be the most practical exemplary embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

Thus, it is seen that improved athletic training devices, systems, and methods, stand assemblies for athletic training devices, and associated manufacturing methods are provided. It should be understood that any of the foregoing configurations and specialized components may be interchangeably used with any of the systems of the preceding embodiments. Although illustrative embodiments are described hereinabove, it will be evident to one skilled in the art that various changes and modifications may be made therein without departing from the disclosure. It is intended in the appended claims to cover all such changes and modifications that fall within the true spirit and scope of the disclosure.

The invention claimed is:

1. An athletic training device comprising:

an elongate container having a first end and a second end and being made of a flexible material, the elongate container being at least partially filled with sand such that the elongate container absorbs impact and provides resistance;

the first and second ends being closed to maintain the sand within the elongate container;

wherein the elongate container has an internal lining having an outside surface, an inner jacket outside the internal lining and bound to the entire outside surface of the internal lining, and an outer jacket outside the inner jacket;

wherein the athletic training device is configured to be hung from one or more of: a ceiling, a hook, a bar, a pipe, or a stand assembly; and wherein the athletic training device is configured to be struck by a user at any point along the length of the elongate container.

2. The athletic training device of claim 1 further comprising a first clamp assembly closing the first end and a second clamp assembly closing the second end.

3. The athletic training device of claim 2 further comprising at least one handle threaded through either the first or second clamp assemblies.

4. The athletic training device of claim 3 wherein the at least one handle is made of rope.

5. The athletic training device of claim 2 further comprising a pair of handles threaded through a respect one of the first and second clamp assemblies.

6. The athletic training device of claim 1 further comprising a first plate and a second plate closing the first or second end.

7. The athletic training device of claim 1 further comprising a handle made of nylon laced elastic shock cord.

8. The athletic training device of claim 1 wherein the elongate container is configured to absorb over 400 lbs of direct impact.

9. The athletic training device of claim 1 wherein the athletic training device is mounted on the stand assembly, the stand assembly including:

a first pipe and a second pipe being equal in length;

a third pipe being longer than the first and second pipe;

a T-connector and two elbow adapters, the first and second pipes being connected via the T-connector and the two elbow adapters such that they are in the same plane, and the third pipe being connected to the first and second pipes via the T-connector and elbow adapters such that the third pipe extends at an angle from the plane;

a fourth pipe threaded through the third pipe;

a fifth pipe being shorter than the first, second, and third pipes, the fifth pipe being attached to the fourth pipe via one of the two elbow adapters; and one or more routing eyebolts attached to one or more of the first, second, and third pipes.

10. The athletic training device of claim 1 wherein the internal lining is made of rubber.

11. An athletic training device comprising:

an elongate container having a first end and a second end and being made of a section of fire hose, the elongate container being at least partially filled with sand such that the elongate container absorbs impact and provides resistance;

the first and second ends being closed to maintain the sand within the elongate container;

wherein the elongate container has an internal lining, an inner jacket outside the internal lining and bound to the internal lining, and an outer jacket outside the inner jacket;

wherein the athletic training device is configured to be hung from one or more of: a ceiling, a hook, a bar, a pipe, or a stand assembly; and wherein the athletic training device is configured to be struck by a user at any point along the length of the elongate container.

12. The athletic training device of claim 11 further comprising a first clamp assembly closing the first end and a second clamp assembly closing the second end.

13. The athletic training device of claim 12 further comprising at least one handle threaded through either the first or second clamp assemblies.

14. The athletic training device of claim 13 wherein the at least one handle is made of rope.

15. The athletic training device of claim 12 further comprising a pair of handles threaded through a respect one of the first and second clamp assemblies.

16. The athletic training device of claim 11 further comprising a first plate and a second plate closing the first or second end.

17. The athletic training device of claim 11 further comprising a handle made of nylon laced elastic shock cord.

18. The athletic training device of claim 11 wherein the elongate container is configured to absorb over 400 lbs of direct impact.

19. The athletic training device of claim 11 wherein the athletic training device is mounted on the stand assembly, the stand assembly including:

a first pipe and a second pipe being equal in length;

a third pipe being longer than the first and second pipe;

a T-connector and two elbow adapters, the first and second pipes being connected via the T-connector and the two elbow adapters such that they are in the same plane, and the third pipe being connected to the first and second pipes via the T-connector and elbow adapters such that the third pipe extends at an angle from the plane;

a fourth pipe threaded through the third pipe;

a fifth pipe being shorter than the first, second, and third pipes, the fifth pipe being attached to the fourth pipe via one of the two elbow adapters; and one or more routing eyebolts attached to one or more of the first, second, and third pipes.

20. The athletic training device of claim 11 wherein the internal lining is made of rubber.

* * * * *